US005098322A

United States Patent [19]

Higby

[11] Patent Number: 5,098,322

[45] Date of Patent: Mar. 24, 1992

[54] MARINE PROPULSION DEVICE WITH SELF ASSEMBLING COOLANT WATER INLET SCREENS

[75] Inventor: Jeffrey P. Higby, Wildwood, Ill.

[73] Assignee: Outboard Marine Corporation, Waukegan, Ill.

[21] Appl. No.: 557,165

[22] Filed: Jul. 23, 1990

[51] Int. Cl.[5] ..... B63H 21/38

[52] U.S. Cl. ..... 440/88; 440/900; 403/339; 403/364; 24/575

[58] Field of Search ..... 440/88, 76, 78, 77, 440/46, 900; 137/550; 403/339, 340, 364; 24/575, 580

[56] References Cited

U.S. PATENT DOCUMENTS

| | | | |
|---|---|---|---|
| 4,636,175 | 1/1987 | Frazzell et al. | 440/88 |
| 4,752,257 | 6/1988 | Karls et al. | 440/76 |
| 4,767,366 | 8/1988 | Lang | 440/76 |
| 4,832,640 | 5/1989 | Karls | 440/88 |
| 4,861,293 | 9/1989 | McGowan et al. | 440/76 |
| 4,954,109 | 9/1990 | McMorries | 440/88 X |

*Primary Examiner*—Edwin L. Swinehart

*Attorney, Agent, or Firm*—Michael, Best & Friedrich

[57] ABSTRACT

A marine propulsion lower unit including spaced first and second sides, first and second water inlet openings respectively located in the first and second sides, a water passage including a laterally extending branch extending between the first and second water inlet openings, and first and second water inlet screen members including respective water inlet screen portions extending across the first and second water inlet openings, and respective first and second portions extending integrally from the water inlet screen portions and having releasable inter-engaging mechanisms for retaining the water inlet screen portions in the water inlet openings.

18 Claims, 2 Drawing Sheets

MARINE PROPULSION DEVICE WITH SELF ASSEMBLING COOLANT WATER INLET SCREENS

BACKGROUND OF THE INVENTION

1. Field of the Invention

The invention relates generally to marine propulsion devices such as outboard motors and stern drive units. More particularly, the invention relates to arrangements for screening the coolant water inlets of such marine propulsion devices.

2. Reference to Prior Art

For many years, marine propulsion devices with coolant water inlets have employed water inlet screens to exclude unwanted debris. Various water inlet screen arrangements for outboard motors are disclosed in the following U.S. Pat. Nos.:

| | | |
|---|---|---|
| 4,636,175 | Frazzell, et al. | January 13, 1987 |
| 4,752,257 | Karls, et al. | June 21, 1988 |
| 4,767,366 | Lang | August 30, 1988 |
| 4,832,640 | Karls | May 23, 1989 |
| 4,861,293 | McGowan, et al. | August 29, 1989 |

SUMMARY OF THE INVENTION

The invention provides a marine propulsion lower unit including spaced first and second sides, first and second water inlet openings respectively located in said first and second sides, a water passage including a laterally extending branch extending between first and second water inlet openings, and first and second water inlet screen members including respective water inlet screen portions extending across the first and second water inlet openings, and respective first and second portions extending integrally from the water inlet screen portions and having releasable inter-engaging means for retaining the water inlet screen portions in the water inlet openings.

The invention also provides a water inlet screen assembly including first and second generally identical water inlet screen members, each of the screen members comprising a support portion having opposed inner and outer margins, a screen portion extending from the outer margin of the support portion, a first finger extending from the inner margin of the support portion and having a planar surface with a series of serrations located thereon in spaced relation from the support portion, and a second finger extending from the inner margin of the support portion and having a surface in co-planar relation to the surface of the first finger and with a series of serrations located thereon in spaced relation from the support portion, which first and second water inlet screen members are assembled to each other with the screen portions located remotely from each other, with the serrations on the first finger of the first water inlet member in engagement with the serrations on the second finger of the second water inlet member, and with the serrations on the second finger of the first water inlet member in engagement with the serrations on the first finger of the second water inlet member.

The invention also provides a water inlet screen assembly including first and second generally identical water inlet screen members, each of the screen members comprising a generally planar support portion having spaced first and second surfaces and opposed inner and outer margins, a screen portion extending from the outer margin of the support portion, a first finger extending from the inner margin of the support portion, having a planar surface parallel to the second surface of the support portion, and having a series of serrations located on the surface of the first finger in spaced relation from the support portion, and a second finger extending from the inner margin of the support portion, having a surface in generally co-planar relation to the planar surface of the first finger, and having a series of serrations located on the surface of the second finger in spaced relation from the support portion, the first and second water inlet screen members are assembled to each other with the screen portions located remotely from each other, with the serrations on the first finger of the first water inlet member in engagement with the serrations on the second finger of the second water inlet member, and with the serrations on the second finger of the first water inlet member in engagement with the serrations on the first finger of the second water inlet member.

The invention also provides a water inlet screen assembly including first and second generally identical water inlet screen members, each of said screen members comprising a generally planar and elongated support portion having spaced first and second surfaces and opposed first and second margins extending in the direction of support portion elongation, a screen portion extending from the first margin of the support portion and including a plurality of sections spaced from each other in the direction of support portion elongation, a first finger extending from the second margin of the support portion, having first and second surfaces parallel to the first and second surfaces of the support portion, having an outer end spaced from the support portion, and having, adjacent said outer end, a camming surface, a second finger extending from the second margin of the support portion, having a first surface in parallel and offset relation to the second surface of said support portion, having a second surface in co-planar relation to the second surface of the support portion, having a series of serrations located on the first surface and extending in the direction of support portion elongation, having an outer end spaced from the support portion, and having, adjacent the outer end, a camming surface and a wall section extending from the second surface and transversely to the support portion, a third finger extending from the second margin of the support portion, having first and second surfaces respectively co-planar with the first and second surfaces of the first finger, having a series of serrations located on the second surface at approximately the same distance from the support portion as the serrations on the second finger and extending in the direction of support portion elongation, having an outer end spaced from the support portion, and having, adjacent the outer end, a camming surface, and a fourth finger extending from the second margin of the support portion, having first and second surfaces respectively generally co-planar with the first and second surfaces of the second finger, having an outer end spaced from the support portion, and having, adjacent the outer end, a camming surface and a wall section extending from the second surface and transversely to the support portion, which first and second water inlet screen members are assembled to each other with the screen portions located remotely from each other, with the support portions in co-planar relation with each other, with the first finger of the first member in adjacent relation to the fourth finger of the second member, with the serrations on the second finger of the first member in engagement with the serrations on the third finger of the second member, with the serrations on the third finger of the first member in engagement with the serrations on the second finger of the second member, and with the fourth finger of the first member in adjacent relation to the first finger of the second member.

The invention provides a water inlet screen comprising a support portion having opposed inner and outer margins, a screen portion extending from the outer margin of the support portion, a first finger extending from the inner margin of the support portion and having a planar surface with series of serrations located thereon in spaced relation from the support portion, and a second finger extending from the inner margin of the support portion and having a surface in co-planar relation to the surface of the first finger and with a series of serrations located on the surface of the second finger in spaced relation from the support portion.

The invention also provides a water inlet screen comprising a generally planar support portion having spaced first and second surfaces and opposed inner and outer margins, a screen portion extending from the outer margin of the support portion, a first finger extending from the inner margin of the support portion, having a surface generally parallel with second surface of the support portion, and having a series of serrations located on the surface of the first finger in spaced relation from the support portion, and a second finger extending from the inner margin of the support portion, having a surface in generally co-planar relation to the surface of the first finger, and having a series of serrations located on the surface of the second finger in spaced relation from the support portion.

The invention also provides a water inlet screen comprising a generally planar and elongated support portion having spaced first and second surfaces and opposed first and second margins extending in the direction of support portion elongation, a screen portion extending from the first margin of the support portion and including a plurality of sections spaced from each other in the direction of support portion elongation, a first finger extending from the second margin of the support portion, having first and second surfaces parallel to the first and second surfaces of the support portion, having an outer end spaced from the support portion and having adjacent the outer end, a camming surface, a second finger extending from the second margin of the support portion, having a first surface in parallel and offset relation to the first surface of said support portion, having a second surface in co-planar relation to the second surface of the support portion, having a series of serrations located on the first surface and extending in the direction of support portion elongation, having an outer end spaced from the support portion and having, adjacent the outer end, a camming surface and a wall section extending from the second surface and transversely to the support portion, a third finger extending from the second margin of the support portion, having first and second surfaces respectively co-planar with the first and second surfaces of the first finger, having a series of serrations located on the second surface at approximately the same distance from the support portion as serrations on the second finger and extending in the direction of support portion elongation, having an outer end spaced from the support portion, and having, adjacent the outer end, a camming surface, a fourth finger extending from the second margin of the support portion, having a first and second surfaces respectively co-planar with the first and second surfaces of the second finger, having an outer end spaced from the support portion and having, adjacent the outer end, a camming surface and a wall section extending from the second surface and transversely to the support portion, and a first groove extending in the first surface of the support portion and the first surface of the second finger and from the first margin of the support portion to the outer end of the second finger.

Other features and advantages of the invention will become apparent to those skilled in the art upon review of the following detailed description, claims and drawings.

THE DRAWINGS

Figure 1:
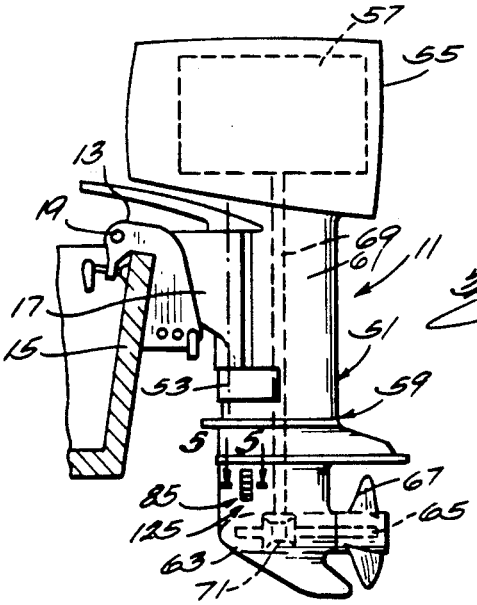
FIG. 1 is a side elevational view of a marine propulsion device which includes a water inlet screen assembly and which embodies various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a marine propulsion device which is in the form of an outboard motor 11 although various of the features of the invention are also applicable to stern drive units. The outboard motor 11 includes a transom bracket 13 adapted to be fixedly mounted to the transom 15 of a boat, and a swivel bracket 17 which is pivotally mounted on the transom bracket 13 for vertical tilting movement about a horizontal tilt axis 19.

The outboard motor 11 also includes a propulsion unit 51 which is connected to the swivel bracket 17 for common movement therewith about the tilt axis 19 and for pivotal movement relative to the swivel bracket 17 about a generally vertical steering axis 53. The propulsion unit 51 comprises a powerhead 55 including an internal combustion engine 57, and a lower unit 59 including a drive shaft housing 61 which, at its upper end, is fixedly connected to the powerhead 55, and which, at its lower end, is fixedly connected to a gearcase 63 rotatably supporting a propeller shaft 65 carrying a propeller 67. The propeller shaft 65 is driven from the internal combustion engine 57 through a vertically extending drive shaft 69 within the drive shaft housing 61 and through a reversing transmission 71 located in the gear case 63 and connecting the drive shaft 69 to the propeller shaft 65.

The lower unit 59 also includes (see FIGS. 5 and 6) spaced left and right sides having therein respective left and right water inlet openings 85 and 87 which are generally rectangular in shape, with the length thereof (or direction of elongation) extending vertically, and which are defined, in part, by forward and rearward wall portions or margins 91 and 93, respectively. The water inlet openings 85 and 87 are respectively preceded by water inlet recess 105 and 107 which progressively decrease in lateral depth from the forward margins 91 toward the front of the lower unit 59.

Located within the lower unit 59 is a water passage 111 including a laterally or horizontally extending branch 113 communicating between the eft and right water inlet openings 85 and 87 and defined by spaced forward and rearward walls 119 and 121. The water passage 111 also includes a vertically extending branch (not shown) which extends upwardly from the laterally or horizontally extending branch 113 and to a water pump (not shown).

Located in the laterally extending branch 113 of the water passage 111 are (see FIG. 2) a first or left water inlet screen member 125 and a second or right water inlet screen member 127. The first and second or left and right water inlet screen members 125 and 127 respectively include left and right water inlet screen portions 135 and 137 which are respectively located in the first and second or left and right side water inlet openings 85 and 87. In addition, the left and right water inlet screen members 125 and 127 include means respectively extending from the water inlet screen portions 135 and 137 and into releasable engagement with each other to prevent separation of the water inlet screen members 125 and 127 from each other and to retain the first or left water inlet screen portion 135 in the left water inlet opening 85 and to retain the right inlet screen portion 137 in the second or right water inlet opening 87.

Preferably, the first and second or left and right inlet screen members 125 and 127 are of identical construction and are preferably fabricated from plastic. As both the first and second water inlet screen members 125 and 127 are identically constructed, only the right inlet screen member 127 will be described in detail.

More specifically, the inlet screen portion 137 has a rectangular outline corresponding to the outline of the right water inlet opening 87 and comprises a series of horizontally extending and generally identical sections or webs or elements 141 which are located in vertical alignment and at approximate even spacing. In the specifically disclosed construction, 16 such sections or elements 141 are employed. A greater or lesser number could be employed.

In horizontal section, each element is generally of right triangular shape with a relatively long forwardly projecting edge 143 which extends into entry recess 107, with a relatively short laterally projecting edge 145 extending at almost a right angle to the forwardly projecting edge 143, and with an outwardly and rearwardly inclined outer edge 147 extending between a forwardly located point 149 which is formed by the forwardly projecting edge 143 and the outer edge 147, and which engages the side wall of the right inlet recess 107, and a rearwardly located juncture or point 151 between the laterally projecting edge 145 and the outer edge 147. The horizontal elements 141 also include, at the rear thereof, a trailing part 155 extending from the juncture 151 between the outer edge 147 and the laterally projecting edge 145 and having a rearward point 157 engaging the right side wall 77 rearwardly of the right water inlet opening 87 in the lower unit 59.

Figure 5:
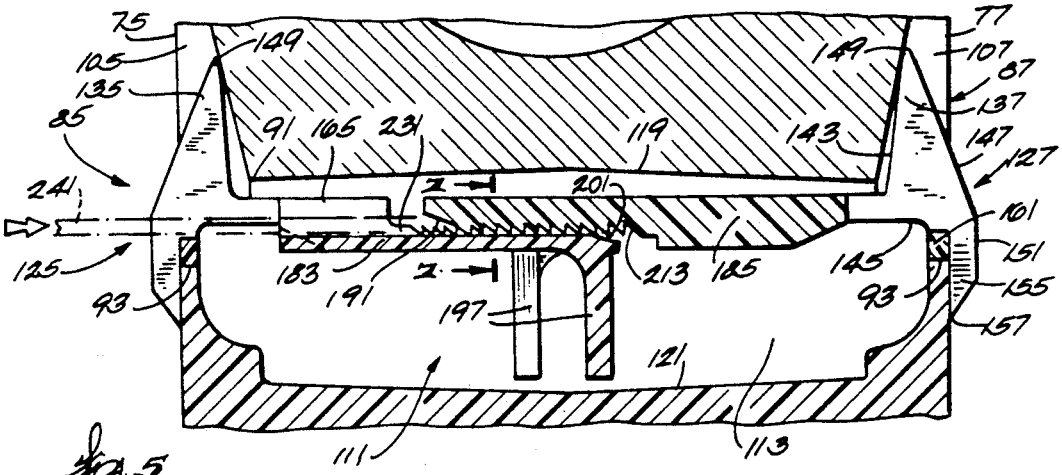
FIG. 5 is an enlarged sectional view taken along line 5—5 in FIG. 1 and illustrating a portion of the arrangement for disassembling the components of the water inlet screen assembly.
Figure 6:
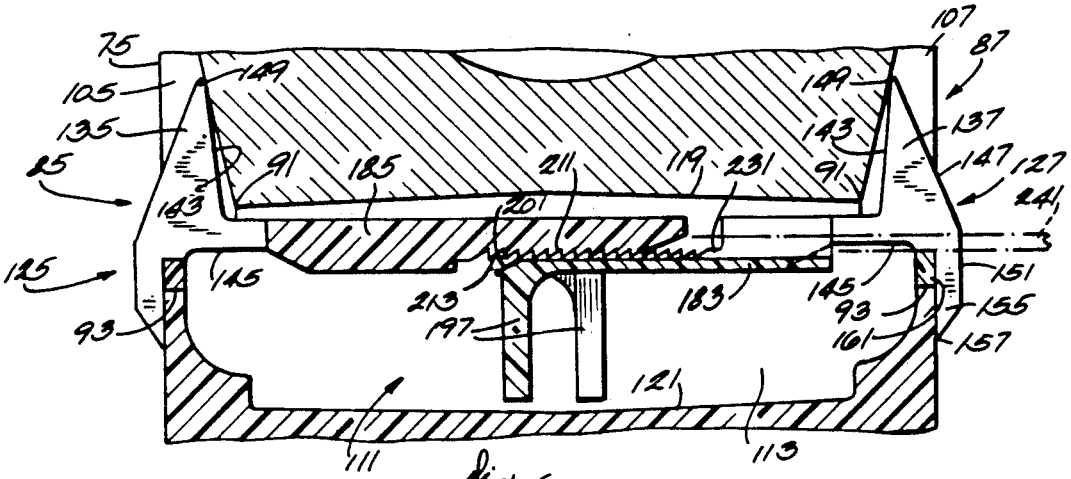
FIG. 6 is a view similar to FIG. 5 and illustrating another portion of the arrangement for disassembling the components of the water inlet screen assembly.

The elements 141 are connected together by a vertically extending solid rib 161 which is included in the trailing part 155 and which is located in rearwardly adjacent relation to the lateral edge 145 of the aligned elements 141. The outer surface of the rib 161 is aligned with the outer surface of the right side wall 77, as shown in FIGS. 5 and 6.

The first or right water inlet screen member 127 also includes, as already indicated, means extending inwardly of the water passage branch 113 from the screen portion 137 for releasable engagement with the other or left inlet screen member 125 to prevent separation or disassembly thereof and to retain the screen portions 135 and 137 in the water inlet openings 85 and 87. In the disclosed construction such assembly means comprises a vertically extending non-broken or solid support portion 165, together with a series of webs 167 extending in co-planar relation to and from the elements 141 to a laterally outward vertical margin 169 of the support portion 165, and a series of fingers projecting from a laterally inward vertical margin 170 of the support portion 165 and in the direction away from the screen portion 137. Still more particularly, the support portion 165 includes spaced first and second or front and rear generally vertically extending surfaces 171 and 173, respectively, which extend between the laterally outward vertical margin 169 connected to the webs 167 and the laterally inward vertical margin 170.

Projecting inwardly from the second or laterally inward margin 170 are a series of four fingers 181, 183, 185, and 187 which extend in generally parallel and spaced relation to each other. While four fingers are employed in the disclosed construction, a greater or lesser number of fingers could be employed. More particularly, the first or outer upper finger 181 extends from the laterally inward margin 170 and has a front surface in generally co-planar relation to the forward surface 171 of the support portion 165. The first or outer upper finger 181 includes a camming surface 191 which tapers from the rear surface toward the front surface, becoming narrower toward the outer end.

The second or inner upper finger 183 extends from the laterally inward margin 170 of the support portion 165 in slightly vertically spaced relation from the first finger 181 and includes front and rear surfaces extending in generally parallel relation to the front and rear surfaces of the first or outer upper finger 181. However, the front surface of the second (or inner upper) finger 183 is generally co-planar with the rear surface of the first (or outer upper) finger 181 and the rear surface of the second finger 183 is generally co-planar with the rear surface 173 of the support portion 165. As a result, a vertically extending shoulder 193 is provided between the second finger 183 and the support portion 165 at the inner margin 170. At the outer end thereof, the second finger 183 is provided with a rearwardly extending wall 197 having an outer vertically extending edge 198 which, when the screen member is assembled in the water passage branch 113, is spaced slightly from the rearward wall 121. Still further in addition, the outer end of the front surface is curved rearwardly to provide a camming surface 201. The second finger 183 has a height equal to approximately twice the height of the first finger 181.

The third (or inner lower) finger 185 is slightly vertically spaced from the second finger 183 and is fabricated generally identically to the first (or outer upper) finger 181, except as described below. The third finger 185 has a height equal to approximately twice the height of the first finger 181. Also, the rear surface of the third finger 185 is generally co-planar with the front surface of the second finger 183. The fourth (or outer lower) finger 187 is fabricated generally identically to the second (or inner upper) finger 183 (including the rearwardly extending wall 197), except as described below. The front surface of the fourth finger 187 has therein a recess 203 which receives a portion of the second finger 183 of the other screen member when the screen members 125 and 127 are assembled as described below. The front surface of the fourth finger 187 is spaced rearwardly from the front surface of the 171 of the support portion 165 so as to provide a shoulder 199 at the junction of the fourth finger 187 and the inner margin 170 of the support portion 165. The rear surface of the fourth finger 187 includes a rearwardly projecting portion 205 located rearwardly of the recess 203.

The right and left screen members 125 and 127 are assembled to each other by insertion thereof laterally into the laterally extending branch 113 of the water passage 111 until the water inlet screen portions 135 and 137 occupy the water inlet openings 85 and 87 and until the screen portions 135 and 137 engage the side walls 75 and 77 of the lower unit 59. However, prior to insertion of the screen members 125 and 127 into the lateral branch 113 of the water passage 111, one screen member is rotated 180° relative to the other screen member so that (with respect to the related screen member) the fingers previously described as the upper fingers are now (in fact) the lower fingers and the lower fingers are now (in fact) the upper fingers.

Figure 2:
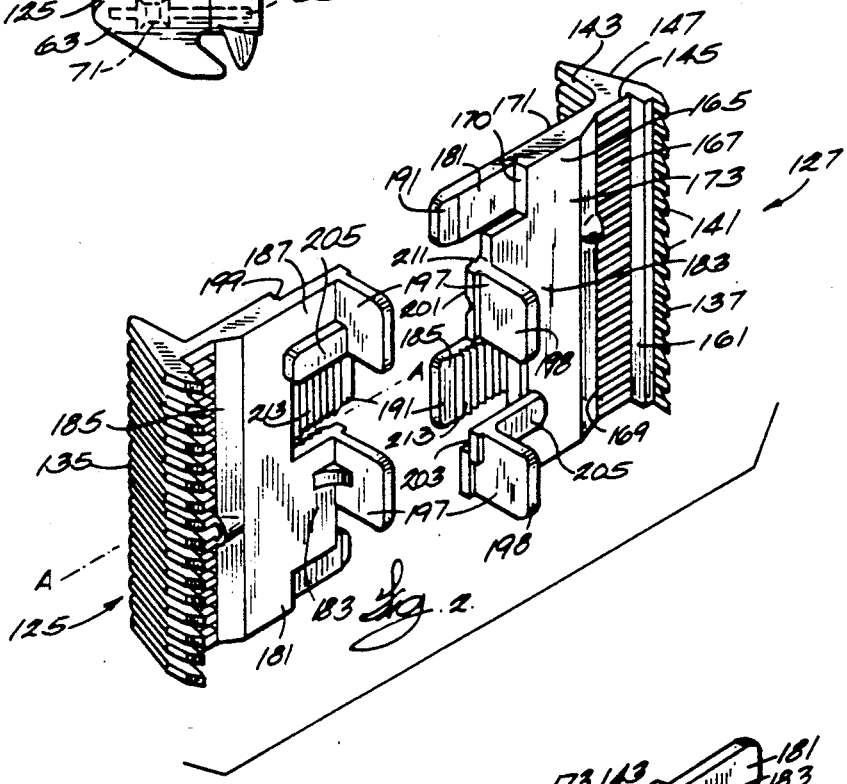
FIG. 2 is an enlarged exploded perspective view, in non-assembled relation of the two components of the water inlet screen assembly shown in FIG. 1.
Figure 3:
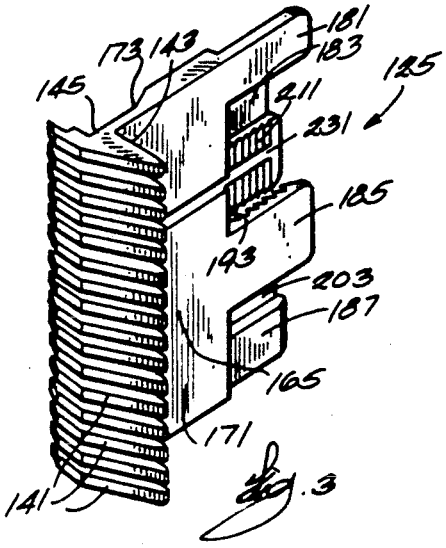
FIG. 3 is an enlarged perspective view of the component shown to the left in FIG. 2 and with the component rotated through an angle of 180° about the axis A—A included in FIG. 2.
Figure 4:
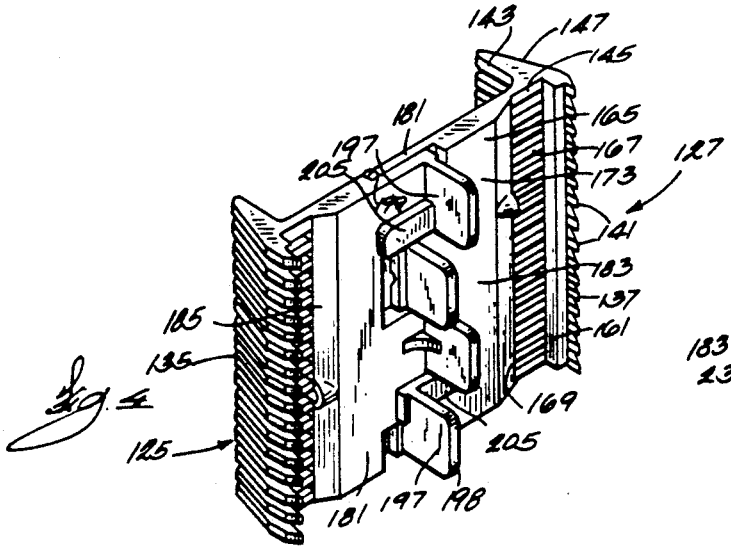
FIG. 4 is a view similar to FIG. 2 and illustrates the assembled relation of the components of the water inlet screen assembly.
Figure 7:
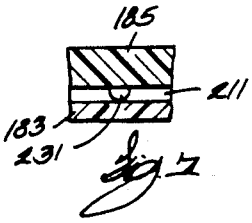
FIG. 7 is a view taken along line 7—7 of FIG. 5.

Upon insertion, the thus oriented screen members 125 and 127 are engaged as indicated in FIG. 2 and as shown in FIG. 4 with each other and with the rear surface of the first finger 181 of the right screen member 127 in engagement with the front surface of the fourth finger 187 of the left screen member 125, with the front surface of the second finger 183 of the right screen member 127 in engagement with the rear surface of the third finger 185 of the left screen member 125, with the rear surface of the third finger 185 of the right screen member 127 in engagement the front surface of the second finger 183 of the left screen member 125, and with the front surface of the fourth finger 187 of the right side member 127 in engagement with the rear surface of the first finger 181 of the left screen member 125. Also, the upper portion of the second finger 185 of the left screen member 125 is received in the recess in the fourth finger 187 of the right screen member 127, and the upper portion of the second finger 185 of the right screen member 127 is received in the recess in the fourth finger 187 of the left screen member 125.

It is noted that in the assemblage, the vertically oriented rearwardly extending walls 197 extend in vertically spaced and laterally offset and aligned relation. The four walls 197 substantially prevent water flow from one side of the passage 113 to the other during a turn. Thus, the walls 197 constitute means for substantially preventing water flow between the inlet openings 85 and 87 and through the passage 113.

Means are provided on the fingers of the left screen member 125 for engagement with similar means on the fingers of the right screen member 127 for holding interengagement therebetween. While other arrangements can be employed, in the disclosed construction, such means comprises, on the front surface of the second or inner upper finger 183, a series of vertically extending serrations or teeth 211, and a similar series of vertically extending serrations or teeth 213 on the rear surface of the third or inner lower finger 185. The serrations 211 on the second or inner finger 183 are located adjacent the outer end thereof and the serrations 213 on the third or inner lower finger 185 are located at about the same distance from the inner margin 170 of the support portion 165 as the serrations 211 on the second or inner upper finger 183.

When assembled, the serrations 211 on the second finger 183 of the right screen member 127 engage with the serrations 213 of the third finger 185 of the left screen member 125. In addition, the serrations 213 on the third finger 185 of the right screen member 127 engage with the serrations 211 on the second finger 183 of the left screen member 125. The serrations 211 and 213 permit sliding engagement over one another until final engagement when the screen members 125 and 127 are in maximum inserted positions in the water inlet openings 85 and 87. In addition, the interengagement of the serrations 211 and 213 thereafter releasably prevents withdrawal of the screen members 125 and 127 from the horizontal branch 113 of the water passage 111 and thereby retains the screen portions 135 and 137 in the water inlet openings 85 and 87.

Means are provided for facilitating disengagement of the serrations 211 and 213 to enable disassembly of the right and left water inlet screen members 125 and 127 for whatever reason, as for instance, for replacement of a damaged screen member.

While other constructions can be employed, in the disclosed construction, the outer ends of the second (or inner upper) and third (or inner lower) fingers 183 and 185 are provided with the before mentioned camming surfaces 191, and the front surface 171 of the support portion 165 and the front surface of the second or inner upper finger 183 are provided with a horizontally extending groove 231 which is accessible through one of the spaces between the elements 141 in the associated screen portion 135 and 137. The groove 231 is adapted to receive a thin tool or implement 241, such as a common construction nail. One tool can be moved through the groove 231 and into the space between the camming surface 201 of the second (or inner upper) finger 183 of the right screen member 127 and the outer end of the third (now inner upper) finger 185 of the left screen member 125, and another tool can be moved through the groove 231 and into the space between the camming surface 201 of the second (now inner lower) finger 183 of the left screen member 125 and the outer end of the inner lower finger 185 of the right screen member 127, whereby to separate the previously engaged fingers from each other and so as to release the serrations 211 and 213 from one another and permit outward withdrawal from the horizontal water passage branch 113 of the left and right screen members 125 and 127.

Thus, the disclosed invention provides identical inlet screen members 125 and 127 which are insertable into the water inlet openings 85 and 87 in the opposite sides 75 and 77 of the lower unit 59 and which can be interengaged with each other to releasably prevent disassembly thereof and to retain the screen portions 135 and 137 thereof in the water inlet openings 85 and 87. Disassembly is provided by inward displacement of a thin tool 241 in each of the grooves 231 provided therefor. Thus the disclosed construction provides identical inlet screen members which can be releasably assembled to each other without the use of screws or other fasteners and which will reliably maintain their positions within the horizontal water passage branch 113 of the lower unit 59 of the outboard motor 11. The disclosed construction also provides a dividing wall (the walls 197) between the inlet openings 85 and 87 to prevent water flow across the passage 113, during a turn, in the event the gearcase does not include such a wall.

Various of the features of the invention are set forth in the following claims.

I claim:

1. A water inlet screen comprising a generally planar and elongated support portion having spaced first and second surfaces and opposed first and second margins extending in the direction of support portion elongation, a screen portion extending from said first margin of said support portion and including a plurality of sections spaced from each other in the direction of support portion elongation, a first finger extending from said second margin of said support portion, having first and second surfaces parallel to said first and second surfaces of said support portion, having an outer end spaced from said support portion and having, adjacent said outer end, a camming surface, a second finger extending from said second margin of said support portion, having a first surface in parallel and offset relation to said first surface of said support portion, having a second surface in co-planar relation to said second surface of said support portion, having a series of serrations located on said first surface and extending in the direction of support portion elongation, having an outer end spaced from said support portion, and having, adjacent said outer end, a camming surface and a wall section extending from said second surface and transversely to said support portion, a third finger extending from said second margin of said support portion, having first and second surfaces respectively co-planar with said first and second surfaces of said first finger, having a series of serrations located on said second surface at approximately the same distance from said support portion as said serrations on said second finger and extending in the direction of support portion elongation, having an outer end spaced from said support portion, and having, adjacent said outer end, a camming surface, a fourth finger extending from said second margin of said support portion, having a first and second surfaces respectively generally co-planar with said first and second surfaces of said second finger, having an outer end spaced from said support portion, and having, adjacent said outer end, a camming surface and a wall section extending from said second surface and transversely to said support portion, and a first groove extending in said first surface of said support portion and said first surface of said second finger and from said first margin of said support portion to said outer end of said second finger.

2. A marine propulsion lower unit including spaced first and second sides, first and second water inlet openings respectively located in said first and second sides, a water passage including a laterally extending branch extending between said first and second water inlet openings, and first and second water inlet screen members including respective water inlet screen portions extending across said first and second water inlet openings, and respective first and second portions extending integrally from said water inlet screen portions and having releasable inter-engaging means for retaining said water inlet screen portions in said water inlet openings, said first and second screen members being substantially identical.

3. A marine propulsion lower unit in accordance with claim 2 wherein said first and second portions each include a first finger having a planar surface and a second finger extending in parallel offset relation to said first finger and having a surface extending in spaced co-planar relation to said surface of said first finger.

4. A marine propulsion lower unit in accordance with claim 3 wherein said surface of said first finger of said first member is in engagement with said surface of said second finger of said second member, and wherein said surface of said second finger of said first member is engaged with said surface of said first finger of said second member.

5. A marine propulsion lower unit in accordance with claim 4 wherein said surface of said first finger of said first member and said surface of said second finger of said second member include engaging means releasably preventing release of the engagement between said finger of first member and said finger of said second member.

6. A marine propulsion lower unit in accordance with claim 5 wherein said engaging means includes releasably engaged serrations on each of said surface of said first finger of said first member and said surface of said second finger of said second member.

7. A marine propulsion lower unit in accordance with claim 6 wherein said first finger of said first member includes an outer end having thereon a camming surface, and wherein said first member includes a groove accessible from exterior of said lower unit and extending to said camming surface to enable engagement with said camming surface of a tool extending in said groove and cooperating with said camming surface to separate said serrations of said first finger of said first member from said serrations of said second finger of said second member.

8. A marine propulsion lower unit including spaced first and second sides, first and second water inlet openings respectively located in said first and second sides, a water passage including a laterally extending branch extending between said first and second water inlet openings, and first and second water inlet screen members including respective water inlet screen portions extending across said first and second water inlet openings, and respective first and second portions extending integrally from said water inlet screen portions and having releasable inter-engaging means for retaining said water inlet screen portions in said water inlet openings, said screen members also including means spaced from said inlet screen portions for substantially preventing water flow between said inlet openings and through said water passage.

9. A water inlet screen-assembly including first and second generally identical water inlet screen members, each of said screen members comprising a support portion having opposed inner and outer margins, a screen portion extending from said outer margin of said support portion, a first finger extending from said inner margin of said support portion and having a planar surface with a series of serrations located thereon in spaced relation from said support portion, and a second finger extending from said inner margin of said support portion and having a surface in co-planar relation to said surface of said first finger and with a series of serrations located thereon in spaced relation from said support portion, said first and second water inlet screen members being assembled to each other with said screen portions located remotely from each other, with said serrations on said first finger of said first water inlet member in engagement with said serrations on said second finger of said second water inlet member, and with said serrations on said second finger of said first water inlet member in engagement with said serrations on said first finger of said second water inlet member.

10. A water inlet screen assembly including first and second generally identical water inlet screen members, each of said screen members comprising a generally planar support portion having spaced first and second surfaces and opposed inner and outer margins, a screen portion extending from said outer margin of said support portion, a first finger extending from said inner margin of said support portion, having a planar surface parallel to said second surface of said support portion, and having a series of serrations located on said surface of said first finger in spaced relation from said support portion, and a second finger extending from said inner margin of said support portion, having a surface in generally co-planar relation to said planar surface of said first finger, and having a series of serrations located on said surface of said second finger in spaced relation from said support portion, said first and second water inlet screen members being assembled to each other with said screen portions located remotely from each other, with said serrations on said first finger of said first water inlet member in engagement with said serrations on said second finger of said second water inlet member, and with said serrations on said second finger of said first water inlet member in engagement with said serrations on ,, said first finger of said second water inlet member.

11. A water inlet screen assembly including first and second generally identical water inlet screen members, each of said screen members comprising a generally planar and elongated support portion having spaced first and second surfaces and opposed first and second margins extending in the direction of support portion elongation, a screen portion extending from said first margin of said support portion and including a plurality of sections spaced from each other in the direction of support portion elongation, a first finger extending from said second margin of said support portion, having first and second surfaces parallel to said first and second surfaces of said support portion, having an outer end spaced from said support portion, and having, adjacent said outer end, a camming surface, a second finger extending from said second margin of said support portion, having a first surface in parallel and offset relation to said first surface of said support portion, having a second surface in co-planar relation to said second surface of said support portion, having a series of serrations located on said first surface and extending in the direction of support portion elongation, having an outer end spaced from said support portion, and having, adjacent said outer end, a camming surface and a wall section extending from said second surface and transversely to said support portion, a third finger extending from said second margin of said support portion, having first and second surfaces respectively co-planar with said first and second surfaces of said first finger, having a series of serrations located on said second surface at approximately the same distance from said support portion as said serrations on said second finger and extending in the direction of support portion elongation, having an outer end spaced from said support portion, and having, adjacent said outer end, a camming surface, and a fourth finger extending from said second margin of said support portion, having first and second surfaces respectively generally co-planar with said first and second surfaces of said second finger, having an outer end spaced from said support portion, and having, adjacent said outer end, a camming surface and a wall section extending from said second surface and transversely to said support portion, said first and second water inlet screen members being assembled to each other with said screen portions located remotely from each other, with said support portions in co-planar relation with each other, with said first finger of said first member in adjacent relation to said fourth finger of said second member, with said serrations on said second finger of said first member in engagement with said serrations on said third finger of said second member, with said serrations on said third finger of said first member in engagement with said serrations on said second finger of said second member, and with said fourth finger of said first member in adjacent relation to said first finger of said second member.

12. A water inlet screen assembly in accordance with claim 11 where each of said first and second water inlet screen members also includes a groove extending in said first surface of said support portion and said first surface of said second finger and from said first margin of said support portion to said outer end of said second finger.

13. A water inlet screen comprising a support portion having opposed inner and outer margins, a screen portion extending from said outer margin of said support portion, a first finger extending from said inner margin of said support portion and including a first planar surface having thereon a first series of serrations located in spaced relation from said support portion, and a second finger extending from said inner margin of said support portion and including a second planar surface in co-planar relation to said first planar surface, and including thereon a second series of serrations in spaced relation from said support portion.

14. A water inlet screen comprising a generally planar support portion having spaced first and second surfaces and opposed inner and outer margins, a screen portion extending from said outer margin of said support portion, a first finger extending from said inner margin of said support portion, having a surface generally parallel with said second surface of said support portion, and having a series of serrations located on said surface in said first finger in spaced relation from said support portion, and a second finger extending from said inner margin of said support portion, having a surface in generally co-planar relation to said surface of said first finger, and having a series of serrations located on said surface of said second finger in spaced relation to said support portion.

15. A water inlet screen in accordance with claim 14 wherein said first finger has an outer end spaced from said support portion and having, adjacent said outer end, a camming surface, and wherein said second finger has an outer end spaced from said support portion and having, adjacent said outer end, a camming surface.

16. A water inlet screen in accordance with claim 14 wherein said surface of said first finger faces in one direction, and wherein said surface of said second finger faces in the opposite direction.

17. A water inlet screen in accordance with claim 14 and further including a groove extending in said first surface of said support portion and said first surface of said first finger and from said outer margin of said support portion to said outer end of said first finger.

18. A water inlet screen in accordance with claim 14 and further including a wall section extending from said second surface of said second finger and transversely to said support portion.

* * * * *